US006026796A

United States Patent [19]

LaPorte et al.

[11] Patent Number: 6,026,796

[45] Date of Patent: Feb. 22, 2000

[54] TARGET LAUNCHER APPARATUS FOR SHOOTING EXERCISE WITH FIRE ARMS

[75] Inventors: Jean Michel LaPorte, Biot; Paul Panara, Villeneuve Loubet, both of France

[73] Assignee: Laporte Ball Trap S.A., Biot, France

[21] Appl. No.: 09/117,384

[22] PCT Filed: Dec. 20, 1996

[86] PCT No.: PCT/FR96/02037

§ 371 Date: Jul. 29, 1998

§ 102(e) Date: Jul. 29, 1998

[87] PCT Pub. No.: WO97/28417

PCT Pub. Date: Aug. 7, 1997

[30] Foreign Application Priority Data

Jan. 29, 1996 [FR] France ..... 96 01244

[51] Int. Cl.[7] ..... F41J 9/18

[52] U.S. Cl. ..... 124/7; 124/8

[58] Field of Search ..... 124/7, 8, 46, 47, 124/48

[56] References Cited

U.S. PATENT DOCUMENTS

| | | | |
|---|---|---|---|
| 2,078,166 | 4/1937 | Schwerin | 124/8 |
| 3,093,127 | 6/1963 | Starr | 124/8 |
| 3,246,642 | 4/1966 | Cleveland . | |

FOREIGN PATENT DOCUMENTS

| | | | |
|---|---|---|---|
| 2557283 | 6/1985 | France | 124/8 |
| 2 587 473 | 3/1987 | France . | |
| 1 801 549 | 2/1970 | Germany . | |
| 1801550 | 2/1970 | Germany | 124/8 |
| 577686 | 6/1958 | Italy | 124/8 |

*Primary Examiner*—John A. Ricci
*Attorney, Agent, or Firm*—Young & Thompson

[57] ABSTRACT

A target or rabbit launcher apparatus for firearm shooting exercise comprises a motor (2), a reducer (3) which actuates by a pendular movement of about 180° an arming rod (4, 5) integral with one or a plurality of arming plates (6, 7). Each arming plate (6, 7) acts, through an arming trigger (8, 9), on an ejection arm (18, 19) by winding up an ejection spring; a locking stud controlled by an electromagnetic unit releases or locks each ejection arm (18, 19) in order to control the shooting; each ejection arm (18, 19) has its shooting rotation axis coaxial with the rotation axis of the arming rod (4, 5) integral with the reducer; the invention applies particularly to the launching of targets of the "rabbit" type.

10 Claims, 4 Drawing Sheets

B-B.

A.A.

TARGET LAUNCHER APPARATUS FOR SHOOTING EXERCISE WITH FIRE ARMS

FIELD OF THE INVENTION

The invention has for its object a target launching apparatus for practicing firing firearms.

The invention is applicable particularly to launching targets of the "rabbit" type. These targets are not to be launched into the air to be sighted and hit in flight, but are adapted to roll on the ground to be hit in their path along the ground.

To this end, these "rabbit" targets or clay pigeons are perfectly circular and comprise a wide periphery serving as a rim which permits them to roll.

The launching apparatus imparts to the targets a rapid rotative movement about their axis. The launching apparatus launches the targets or "rabbits" by making them roll.

BACKGROUND OF THE THE SUMMARY

At present, right and left firing are more and more popular. The object is to hit two targets with two successive rounds.

For right and left with targets of the "rabbit" type, this is possible only with two launching devices disposed side by side. Launching with the same apparatus two successive targets is not sufficiently rapid, the time delay between the two launches is too long. The use of two launching apparatuses has its drawbacks. The cost is high, manipulation, transportation and storage are multiplied by two, the space occupied on the firing range is also too great.

The invention seeks to overcome all these problems.

The launching apparatus according to the invention can launch right and left with a single launcher, and the same and single motor, each launching arm being independent.

The state of the art can be defined by the following patents:

FR-A-2,587,473: the apparatus is remarkable, particularly in that it comprises a flexible vertical wheel mounted rotatably above a launching ramp in which the targets are moved vertically one by one. Upstream of the wheel are mounted two retention members which retain the targets in the ramp. These retention members have controlled action and have for their object, on the one hand, to retain the targets in the ramp upstream of the wheel and on the other hand to press the targets one by one toward the wheel. The wheel grasps the targets one by one and launches them along the ground by imparting to them a rapid rotation movement about their axis.

The apparatus according to the invention has been principally adapted to launch targets of the "rabbit" type.

U.S. Pat. No. 3,246,642: in a mechanism driven by the target, in combination with a target in the form of a disc, said mechanism is characterized by launching the target straight in a predetermined horizontal direction, so as to roll continuously along the environs of the target, said launching being characterized by impressing a movement of translation on the target and is characterized by said translatory movement so as to communicate rotation to the target about its axis with a peripheral velocity at least equal substantially to its speed of translation, said launch being characterized by the rolling of the target along the ramp whilst the target bears on said ramp of curved form, receiving and guiding freely the target and having a lower portion conforming to the periphery of the target, the depth of the curve is adjustable for reception of discs of different sizes.

None of these launchers discloses an apparatus permitting launching left and right.

SUMMARY OF THE INVENTION

The launching apparatus according to the invention is of the type using a motor, a motor reducer, a loading arm, an ejection spring, an ejection arm, it is characterized by the fact that it comprises a motor, a reducer which drives, by pendulous movement, a loading rod secured to one or several loading plates, each loading plate acting, by a loading trigger, on an ejection arm by compressing the ejection spring, a blockage lug controlled by an electromagnetic housing frees or blocks each ejection arm so as to control commencement of firing. Each ejection arm has its axis of rotation coaxial to the axis of rotation of the loading rod secured to the reducer.

According to a particular embodiment, the motor is disposed vertically with, in prolongation thereof, the reducer, perpendicular to the longitudinal axis of said reducer, a loading arm emerges from each side of said reducer secured each to a loading plate, driven by the same pendulous movement of about 180°.

Each loading plate is provided with a loading trigger, mounted on a pivotal axis provided with a return spring and an abutment driven by the pendulous movement of the arm and rod, the end of the trigger will press the loading finger of the ejection arm to cause it to turn compressing the ejection spring until said finger passes the axis of rotation of the ejection arm, a blockage lug blocks the ejection arm in this loaded position.

One of the two loading rods is provided with an eccentric with a rod/crank device which actuates the supply of targets from two chutes in the ejection arm. Each ejection arm has the shape of a U-shaped profile whose ends of the legs of the U are provided with a return which permits the targets not to fall and to roll in the ejection arm to the ejection at the level of the end opposite to the axis of articulation.

The supply chute for the targets opens at the level of the end of the ejection arm which is opposite the pivotal axis of said ejection arm. This supply chute is inclined, its lower end slopes such that the targets can leave said supply chute and come into place in the profile which serves as a rolling path for the ejection arm.

According to a particular embodiment, the launcher according to the invention is provided with two loading rods disposed on opposite sides of the reducer, each rod, by its loading plate and its pendulous movement, ensuring the loading of an ejection arm, each ejection arm being blocked, once loaded, by a blockage lug. The commencement of firing is thus independent for each ejection arm.

BRIEF DESCRIPTION OF THE DRAWINGS

The accompanying drawings are given by way of examples and are not limiting. They show a preferred embodiment according to the invention. They permit easy comprehension of the invention.

DETAILED DESCRIPTION OF THE INVENTION

Figure 1:
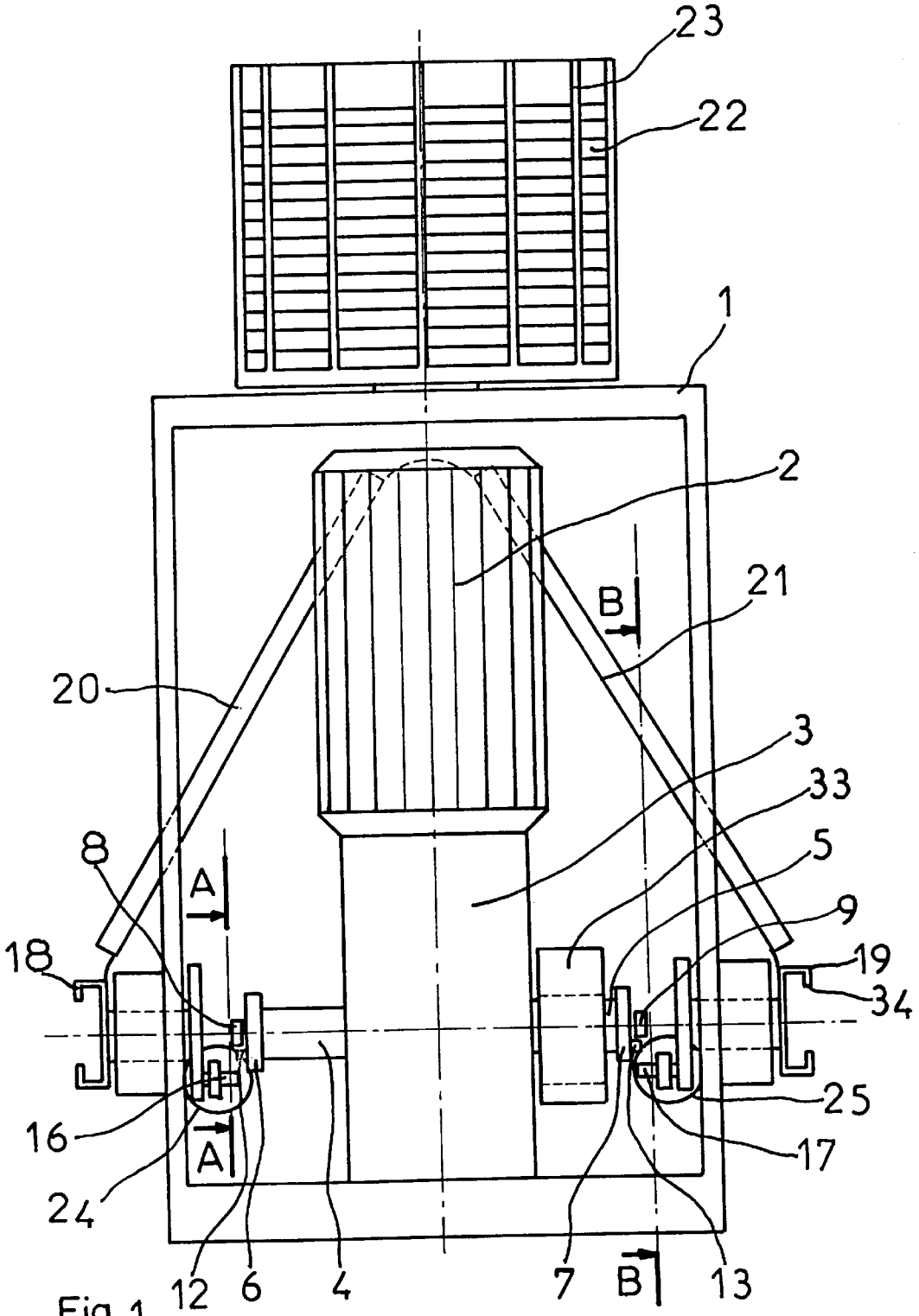
FIG. 1 is a front view of the target launching apparatus for practicing firing firearms.
Figure 2:
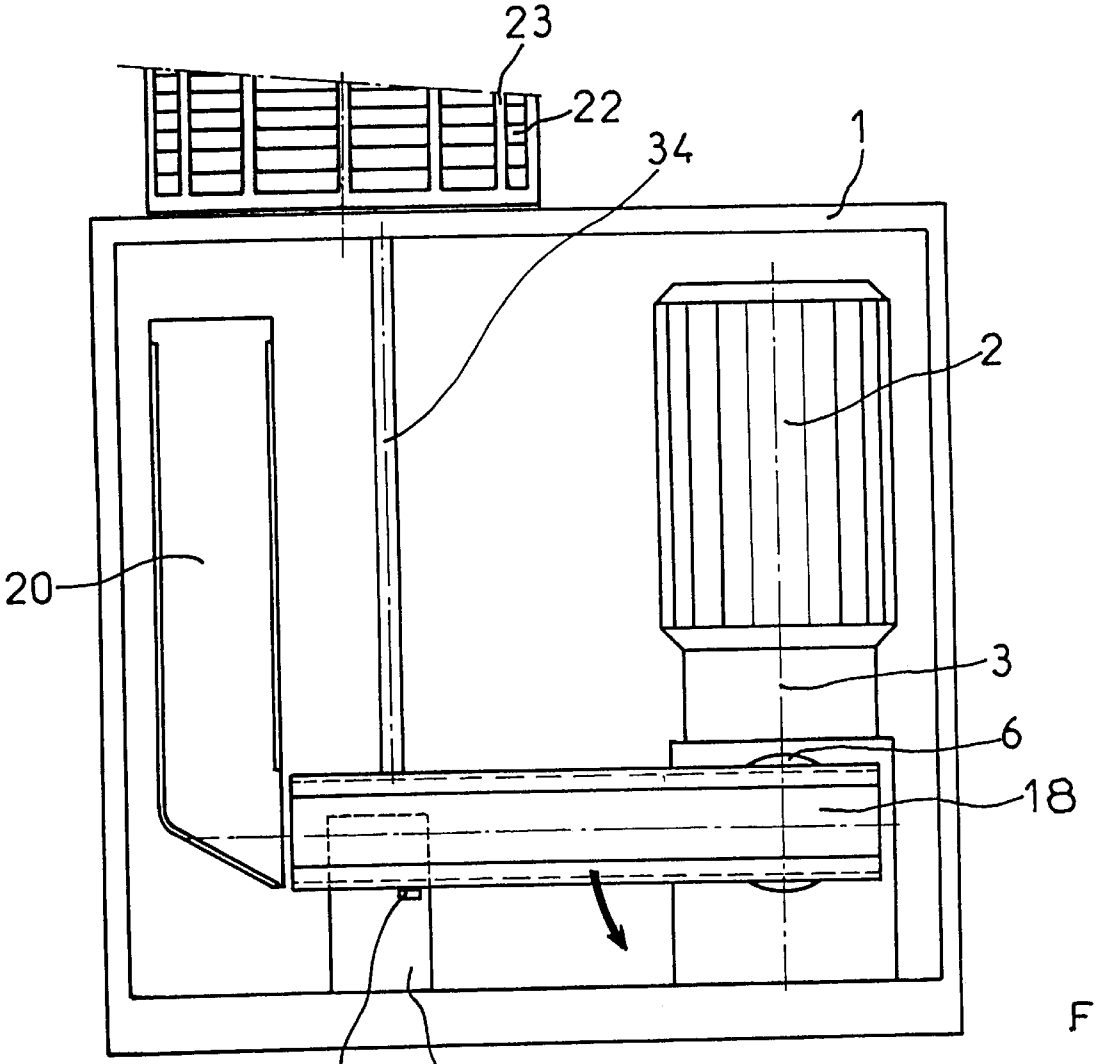
FIG. 2 is a side view of the launching apparatus showing the ejection arm and the supply chute.
Figure 3:
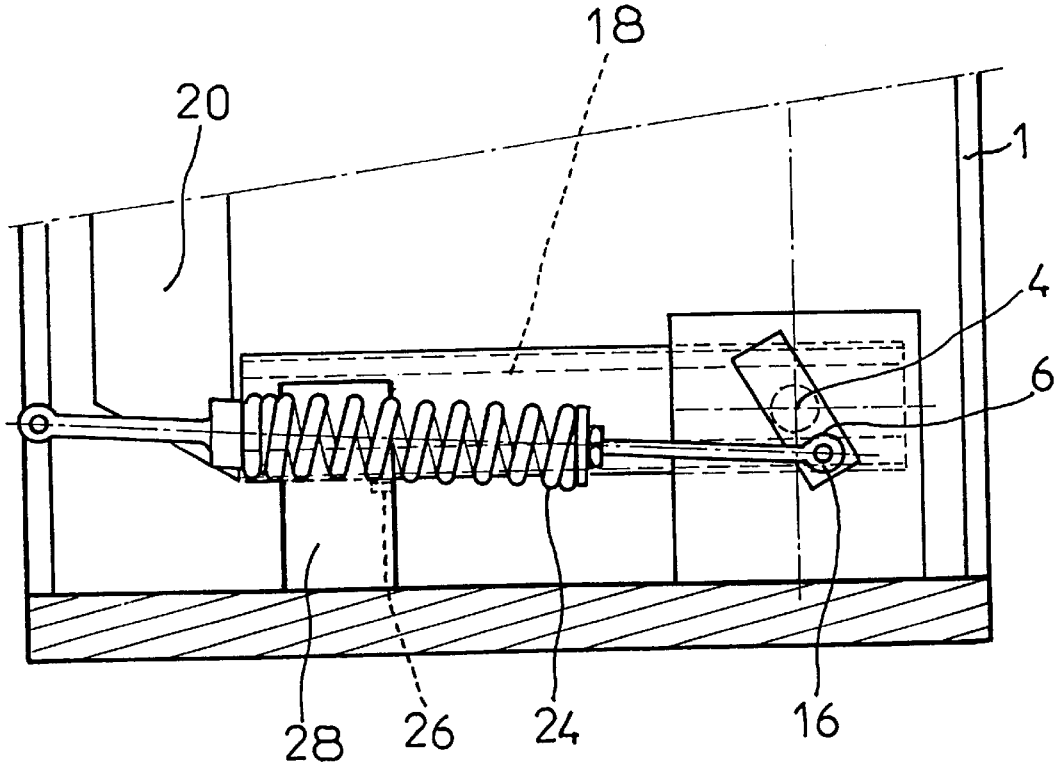
FIG. 3 is a side view of the launching apparatus showing the ejection arm and the ejection spring as well as its anchoring points.

The launching apparatus shown in FIG. 1 is comprised by the following elements. In a frame 1, are disposed vertically a motor 2 in which and in the prolongation of which is disposed a reducer 3.

Emerging from the reducer 3 are loading rods 4 and 5 that are driven with a pendulous movement. These rods are secured at their end to a loading plate 6, 7. The loading plate is itself provided with a loading trigger 8, 9. The loading trigger 8, 9 is provided with a return spring 10 shown in FIG. 5.

On the loading plate 6, 7, an abutment 12, 13 permits the loading trigger 8, 9 to come into abutment. The loading trigger 8, 9 is movably mounted about an axis 31.

The loading trigger 8, 9 in its pendulous movement, driven by the loading rods 4, 5, can come into contact with a loading finger 30 disposed facing and belonging to the ejection arm 18, 19 (see FIGS. 4 to 9).

The ejection arms 18, 19 are supplied with targets by supply chutes 20, 21, said supply chutes are in plan inclined and receive the targets or "rabbits" 22 which are distributed in a known manner by a drum 23. The drum 23 is disposed above the chassis 1 of the target launching apparatus.

The motor 2 and the reducer 3 drive by a pendulous movement a loading rod 4, 5 which is itself secured at its end to a loading plate 6, 7.

Each loading plate acts, by a loading trigger 8, 9, on an ejection arm 18, 19 by compressing the ejection spring 24, 25.

A blockage lug 26, 27 which serves as an ejection trigger is disposed in an electromagnetic housing 28, 29 for commencing firing. Each ejection arm 18, 19 has an axis of rotation which is coaxial to the axis of rotation of the loading rod 4, 5. The loading rod 4, 5 is itself secured to the reducer 3.

As can easily be seen in FIG. 1, the motor 2 is disposed vertically with, in its prolongation to the level of its lower part, the reducer 3. Perpendicularly to the reducer 3 are located, disposed on opposite sides of each side, a loading rod 4, 5 which emerges from said reducer 3. The end of each of these loading rods 4, 5 is secured to a loading plate 6, 7. Each loading plate 6, 7 is driven with a same pendulous movement.

According to a particular embodiment, this pendulous movement is about 180°.

FIGS. 4, 5, 6, 7, 8 and 9 permit comprehension of the coaction which exists between the loading plate 6, 7, the loading trigger 8, 9 and the loading finger 30 of the ejection arm 18, 19.

FIGS. 4, 5, 6, 7, 8 and 9 show a single side of the target launching apparatus. Of course, the same elements are to be found on both sides of the reducer 3, which is true for each loading rod 4, 5 and each loading plate 6, 7.

Figure 4:
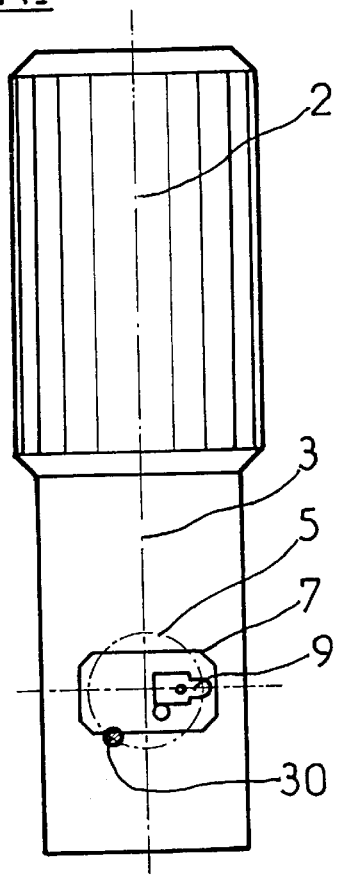
FIG. 4 is a side view showing the motor, the reducer, the loading rod, the loading plate, the loading trigger, the abutment of the loading trigger, and the loading finger of the ejection arm.

FIG. 4 represents the so-called zero position of the reducer.

The loading plate 7, secured to the axle of the reducer 3, has a pendulous movement of 180° in amplitude.

Figure 5:
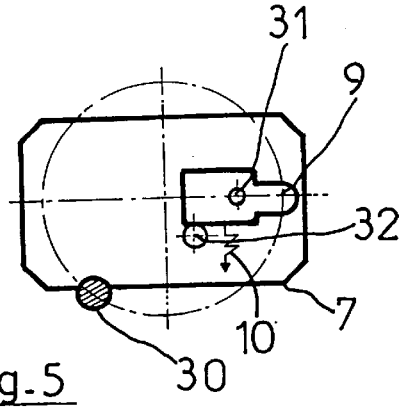
FIGS. 5, 6, 7, 8 and 9 show schematically the sequence of operation of the loading plate, of the loading trigger of the ejection arm, of its abutment and of the loading finger which itself is secured to said ejection arm.

FIG. 5 shows the device after ejection. In broken lines is shown the trajectory of the loading finger 30 of the ejection arm 18. This FIG. 5 shows the coaxial intersection of the axis of the reducer 3 and the axis of the ejection arm (not shown). The loading trigger 9 is pivotally mounted about an axis 31, and is itself provided with a return spring 10. It comprises also an abutment 32.

Figure 6:
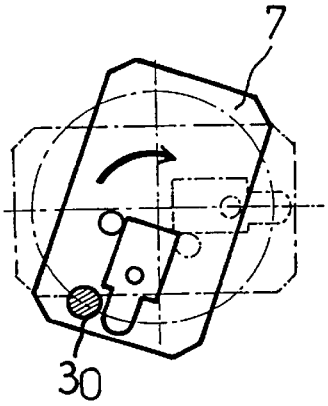

FIG. 6 shows the loading movement effected by the reducer 3 and its loading rod 5. The trigger 9 presses the loading finger 30 of the ejection arm 18.

Figure 7:
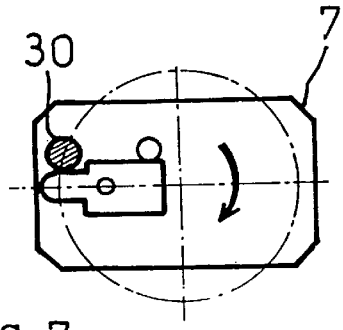

FIG. 7 shows the extreme position of the pendulous movement of the reducer to the so-called loading position. The loading finger 30 has then passed beyond the axis of rotation of the ejection arm 18. The loading finger 30 is in position ready to eject.

Figure 8:
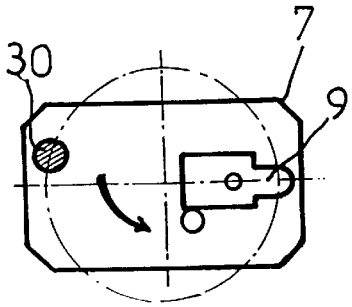

FIG. 8 shows the return to zero position of the reducer with its plate 7 and its loading trigger 9. The loading finger of the ejection arm remains in position 30 as shown in FIG. 8. The ejection arm 18 is only maintained blocked by its blocking finger, its blockage lug 26 which serves as an ejection trigger. Thanks to the electromagnetic housing 28 or 29, the commencement of firing will take place and this independently of the pendulous movement of the reducer. As soon as the blockage lug 26 is disengaged, the ejection arm will have made a complete turn and ejected its target 22.

Figure 9:
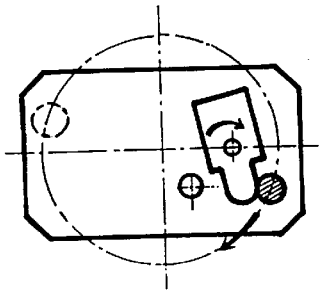

FIG. 9 shows the ejection phase or firing, the ejection spring 24 or 25 effects the rotation of the ejection arm 18 or 19, thereby permitting ejection of the target 22 which has first been placed in said ejection arm 18 or 19. The rotation of the ejection arm takes place of course at the same time as the movement of the finger. This finger, as shown in FIG. 9 presses the loading trigger 9, thereby permitting the passage of said finger by retraction of said trigger. The trigger will return to its initial position under the effect of its return spring (not shown).

As shown in the figures, it will therefore be understood that with a single motor and a single reducer, the two loading rods 4 and 5 can carry out loading of each ejection arm. As to firing the ejection arms, this is carried out independently of said loading, and thus permits releasing two targets with all the desired parameters as to the lapse of time between the two shots.

It is also possible to use said launching apparatus for launching one at a time without right and left operation.

One of the two loading rods 4 or 5 is provided with an eccentric 33 which, with a rod or crank device 34, actuates the supply of targets 22 by the chutes 20, 21 in the ejection arm.

The supply chutes 20 and 21 for targets 22 open at the level of the end of each ejection arm 18, 19, which end is opposite the axis of articulation or axis of rotation of said ejection arms 18, 19. Each supply chute 20, 21 is inclined, its lower end comprises an inclined plane such that the targets 22 can leave said supply chute 20, 21 and come into place within the profile which serves as the rolling path of each ejection arm 18, 19.

REFERENCES

1. Frame
2. Motor
3. Reducer
4, 5. Loading rods
6, 7. Loading plate
8, 9. Loading trigger
10, 11. Return spring
12, 13. Abutment
16, 17. Loading finger

18, 19. Ejection arm
20, 21. Supply chute
22. Targets or "rabbits"
23. Drum
24, 25. Ejection spring
26, 27. Blockage lug
28, 29. Electronic housing to commence firing
30. Loading finger of the ejection arm
31. Axis of the loading trigger
32. Abutment of the loading trigger
33. Eccentric
34. Rod or crank

What is claimed is:

1. A launching apparatus for launching targets from a drum supplying targets, comprising a motor having a reducer operatively associated therewith; a loading rod secured to said reducer and to at least one loading plate; said loading rod adapted to be driven with a pendulous movement by said reducer; each loading plate acting via a loading trigger on an ejection arm by compressing an ejection spring; a blockage lug controlled by an electromagnetic unit for releasing or blocking the ejection arm in order to control launching; and said ejection arm having an axis of rotation coaxial with the axis of rotation of the loading rod.

2. The launching apparatus according to claim 1, wherein the motor and the reducer are vertically aligned, said reducer extending in a longitudinal direction and having sides perpendicular to the longitudinal direction, a loading rod emerging from each side of said reducer; and each loading rod being secured to a loading plate driven with the same pendulous movement of about 180°.

3. The launching apparatus according to claim 2, wherein each loading rod is driven with a pendulous movement; each rod being secured at one end to a loading plate; each loading plate including a loading trigger and abutment means for allowing the loading trigger to come into abutment thereagainst; each loading trigger being provided with a return spring; said loading trigger being pivotally mounted about an axis, and being structured and arranged to come into contact with a loading finger of a corresponding ejection arm.

4. The launching apparatus according to claim 3, wherein each loading plate acts, via a loading trigger, on an ejection arm by compressing the ejection spring.

5. The launching apparatus according to claim 3, wherein the blockage lug which functions as an ejection trigger is disposed in the electromagnetic unit, each ejection arm having its axis of rotation coaxial with the axis of rotation of a corresponding loading rod; and each loading rod being secured to the reducer.

6. The launching apparatus according to claim 3, wherein each loading trigger is operatively associated with an abutment on a corresponding loading plate.

7. The launching apparatus according to claim 6, wherein each loading trigger is structured and arranged to press a corresponding loading finger of a respective ejection arm to cause said loading finger to rotate by compressing the ejection spring until the loading finger has reached a loaded position beyond the axis of rotation of the ejection arm; said blockage lug blocking the ejection arm in said loaded position, and functioning as an ejection trigger whereby, as soon as the blockage lug is disengaged, the ejection arm carries out a complete turn and ejects a target.

8. The launching apparatus according to claim 7, further comprising means for emplacing a target from the drum in the ejection arm, and wherein the ejection spring effects the rotation of the ejection arm thereby allowing ejection of the target; the loading finger being structured and arranged to press the loading trigger thereby permitting passage of said finger by retraction of said trigger; and said trigger resuming its initial position under the effect of its return spring.

9. The launching apparatus according to claim 2, wherein one of the two loading rods is provided with an eccentric which, via a crank device, actuates the drum supplying the targets by two chutes in the ejection arms; each supply chute opening at the level of a first end of a corresponding ejection arm, said first end being opposite the axis of rotation of said corresponding ejection arm; each supply chute being inclined, and having a lower inclined end such that the targets leave the supply chute and come into place in a profile which serves as a rolling path for each ejection arm.

10. The launching apparatus according to claim 1, wherein each loading plate includes a loading trigger mounted on an axis of articulation, provided with a return spring, and an abutment driven by the pendulous movement of the loading rod; the trigger having an end structured and arranged to press a loading finger of the ejection arm to cause said loading finger to rotate by compressing the ejection spring until said finger reaches a loaded position following passage beyond the axis of rotation of the ejection arm; and said blockage lug blocking the ejection arm in said loaded position.

* * * * *